US007641141B2

(12) United States Patent
Pellengo Gatti

(10) Patent No.: US 7,641,141 B2
(45) Date of Patent: Jan. 5, 2010

(54) METHOD AND APPARATUS FOR WINDING AND REMOVING CORELESS ROLLS FROM A SPINDLE

(75) Inventor: Roberto Pellengo Gatti, Novara (IT)

(73) Assignee: No. El. S.r.l., San Pietro Mosezo, Novara (IT)

( * ) Notice: Subject to any disclaimer, the term of this patent is extended or adjusted under 35 U.S.C. 154(b) by 243 days.

(21) Appl. No.: 11/632,659

(22) PCT Filed: May 18, 2005

(86) PCT No.: PCT/EP2005/005369

§ 371 (c)(1),
(2), (4) Date: Jan. 17, 2007

(87) PCT Pub. No.: WO2006/012933

PCT Pub. Date: Feb. 9, 2006

(65) Prior Publication Data

US 2008/0035781 A1 Feb. 14, 2008

(30) Foreign Application Priority Data

Aug. 5, 2004 (IT) ..... MI2004A1608

(51) Int. Cl.
*B65H 19/28* (2006.01)

(52) U.S. Cl. ..... 242/532.2; 242/576.1

(58) Field of Classification Search ..... 242/332.3, 242/532.2, 533.4, 571, 576, 576.1
See application file for complete search history.

(56) References Cited

U.S. PATENT DOCUMENTS

| | | | | |
|---|---|---|---|---|
| 2,575,631 | A * | 11/1951 | Link | 242/532.2 |
| 5,337,968 | A | 8/1994 | De Bin et al. | |
| 5,797,559 | A * | 8/1998 | Coffey | 242/527.6 |
| 6,186,436 | B1 * | 2/2001 | Selle et al. | 242/532.2 |
| 6,270,034 | B1 | 8/2001 | Kury et al. | |
| 6,412,729 | B2 * | 7/2002 | Kury et al. | 242/533.4 |
| 6,595,458 | B1 | 7/2003 | Biagiotti | |

FOREIGN PATENT DOCUMENTS

| | | |
|---|---|---|
| EP | 0 831 047 | 3/1998 |
| EP | 0 995 708 | 4/2000 |
| WO | WO 99/06312 | 2/1999 |

* cited by examiner

*Primary Examiner*—Sang Kim
(74) *Attorney, Agent, or Firm*—Young & Thompson

(57) ABSTRACT

A coreless roll (12) of a plastic film (10) is directly wound onto a tubular spindle (11); the spindle (11) is provided with an air chamber (11P) having a perforated side wall (11W), which communicate with a pressurised air source (27). At the removal of the roll (12), the inner turns of the roll (12) are radially expanded by feeding a pressurised airflow into the winding spindle (11) and the roll (12); the pressurised air is fed for a length of time required for the removal of the roll (12).

28 Claims, 4 Drawing Sheets

METHOD AND APPARATUS FOR WINDING AND REMOVING CORELESS ROLLS FROM A SPINDLE

BACKGROUND OF THE INVENTION

This invention refers to the production of coreless rolls, according to which a film of plastic material is directly wound up onto a spindle, and in particular the invention is directed to a method for winding up and removing a coreless roll from a winding spindle, to an air-pressure assisted spindle and to a pneumatic apparatus, designed to allow the winding and removal of coreless rolls from the spindle, in a very simple way.

STATE OF THE ART

Extensible and heat-shrinkable plastic films, wound in rolls, are normally used for packaging and for wrapping palletised loads or goods.

In forming the rolls, a plastic film directly from a production line, or from a large roll, is normally wound into rolls of small dimensions, supporting the rolls during winding by an appropriate tubular core of rigid material, previously fitted onto a rotating spindle; upon completion of a roll, the latter can be removed by simply withdrawing it, axially from the spindle, together with the tubular support core.

The use of tubular support cores of plastic material or cardboard is generally required since, in addition to facilitating the winding of the plastic film, it helps to maintain a stable shape of the roll and its easy withdrawal or removal from the spindle.

The current tendency however is to eliminate the use of cores for winding rolls of plastic film, both in order to reduce costs, and to eliminate several problems in terms of procurement, transport and storage in the warehouse of the tubular cores, prior to their use.

In this connection, it has been variously suggested to eliminate the use of the usual tubular cores and to form coreless rolls by winding up the plastic film directly onto an expandable spindle, as described for example in EP-A-1 001 908.

According to this document, use is made of an expandable spindle or mandrel, capable of assuming two different diameters or configurations. In particular the spindle comprises tubular body and an inflatable bladder, capable of protruding through longitudinal slots of the spindle body, during winding, to support the roll of the plastic film; upon completion of a roll the internal bladder is deflated and the diameter of the spindle is reduced to enable the roll to be removed; it has also been suggested to use mechanically-expandable spindles.

A solution of this kind proves to be somewhat complex and difficult to use with different types of spindles, especially with spindles of large dimensions in that it does not allow an adequate control of the diameter of the roll, owing to a possible elastic yielding of the internal bladder protruding from the longitudinal slots, due to the winding tension of the plastic film.

OBJECTS OF THE INVENTION

The main object of this invention is to provide a method for winding up and removing rolls of plastic film, of coreless type, which makes use of a pressure assisted spindle of special design, whereby it makes possible to wind up the plastic film directly on the outer cylindrical surface of a tubular body, to produce coreless rolls in an extremely controlled way, while ensuring constancy in the shape of the rolls, and its easy removal.

A further object of the invention is to provide a spindle for winding up coreless rolls, according to which use is made of a structurally simple solution, easily adaptable to any type of apparatus for winding up any type of plastic film into coreless rolls.

A still further object is to provide an apparatus suitable for implementing the method and use a pressure assisted spindle according to the invention.

BRIEF DESCRIPTION OF THE INVENTION

The method according to the invention comprises the steps of winding up a roll of plastic film directly onto a tubular body of a spindle having perforations on a peripheral wall, in the absence therefore of any support core and, at the removal, causing an expansion of some internal turns of the roll by feeding a pressurised air flow into the tubular body and through the perforated wall of the spindle to disengage the internal turns of the roll from said peripheral wall of the spindle allowing the withdrawal of the same roll.

The spindle according to the invention comprises:

an elongated hollow body, provided with a tubular chamber longitudinally extending to a peripheral wall, said wall having an outer winding surface;

a plurality of perforations opening out from the tubular chamber onto an outer surface of the peripheral wall; and a pneumatic joint conformed to rotatably support the spindle and to connect the tubular chamber of the spindle to a pressurised air source.

The air-outlet holes or perforations can be disposed and oriented on the peripheral wall of the spindle body in any way with respect to a longitudinal axis of the spindle.

In particular, the air-outlet holes can be aligned in rows of holes parallely arranged to the longitudinal axis of the spindle, or helically disposed, at a constant and/or variable pitch, according to the requirements.

The number of holes, their disposition on the peripheral wall, and their cross-sectional areas for the air flow, must be chosen such as to cause a controlled distribution of the pressurised air in the tubular chamber, of spindle, to avoid an excessive pressure drop in the final section of the chamber at the end opposite to the inlet side for the pressurised air. Therefore the number, and/or the distances between holes or perforations, and/or the dimensions of the holes themselves, may vary along the same spindle, and/or in spindles of different types, for winding rolls of different plastic films; for example the holes may be uniformly distributed on the body of the spindle, or grouped on one or more wall areas.

As alternative embodiments, the perforated wall of the spindle may consist of porous sintered ceramic or metal material, a microperforated plate or a fine meshed grid or net; as general rule, for the present invention, the total perforated area of the peripheral wall of the spindle, should be equal to or less than the cross-sectional area of a feeding duct for the pressurised air flow at one end of the tubular chamber of the spindle.

BRIEF DESCRIPTION OF THE DRAWINGS

These and further features of the claimed method, and some preferential embodiments of a spindle and an apparatus according to the invention, will be more clearly evident from the following description, with reference to the drawings, in which:

DETAILED DESCRIPTION OF THE INVENTION

Figure 1:
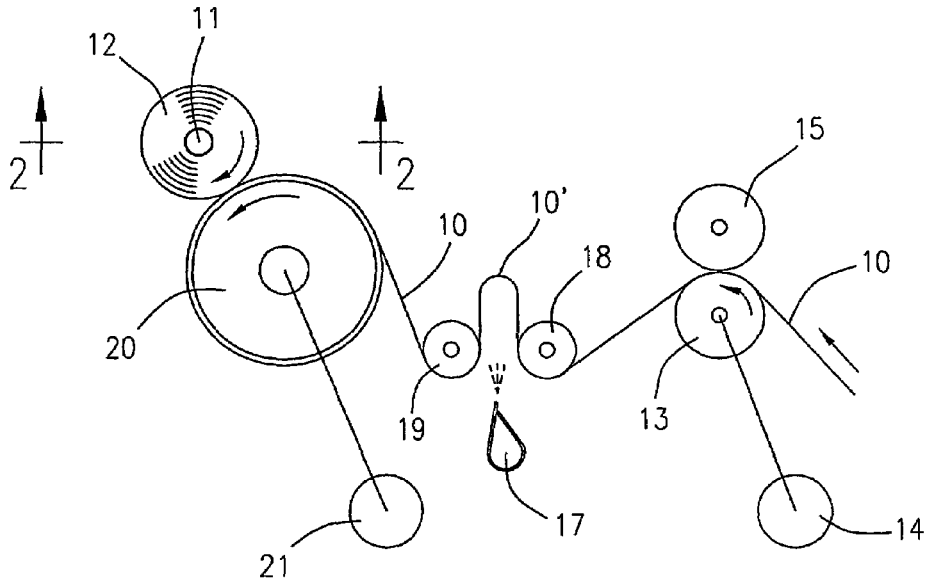
FIG. 1 schematically shows an apparatus for winding up coreless rolls of plastic film, according to the invention.

In FIG. 1, reference number 10 has been used to indicate a plastic film of any type, for example a heat-shrinkable or extensible film, if necessary prestretched, which must be wound onto a spindle 11 to form a roll 12 in a per se known way.

The apparatus of FIG. 1 comprises for example a feeding unit for a film 10, including a first drawing roller 13 operated by an electric motor 14, and a pressure roller 15 supported to idle rotate.

The plastic film 10, in FIG. 1 is moving towards two guide rollers 18, 19 to form a loop 10' floatingly sustained for example by an air flow generated by a nozzle 17, in a position between the two guide rollers 18, 19; the film 10 is drawn or pulled by a drum 20, operated by an electric motor 21, which is appropriately controlled with respect to the electric motor 14 of the drawing roller 13 of the feeding unit, by an electronic control unit, not shown.

The spindle 11 may be supported to idle rotate, by a movable arm, not shown, whereby the roll 12, during its winding, can be urged against the drawing drum 20, causing the same roll 12 to rotate with a constant peripheral speed.

The roll 12 of plastic film is directly wound up onto the outer surface of the spindle 11, without any supporting core; therefore, upon completion the winding of a roll 12, when it must be removed, the roll 12 is disengaged from the spindle 11 to enable it to be withdrawn.

Figure 2:
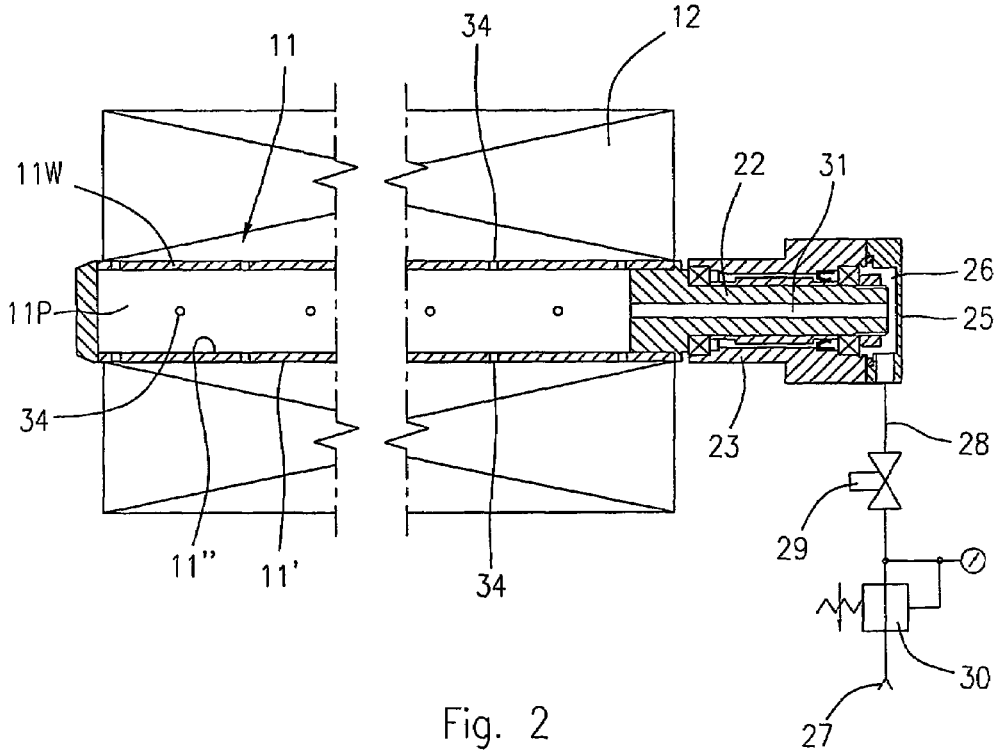
FIG. 2 shows a longitudinal cross sectional view of a spindle, along the line 2-2 of FIG. 1, and a coreless roll during the winding of a plastic film.
Figure 3:
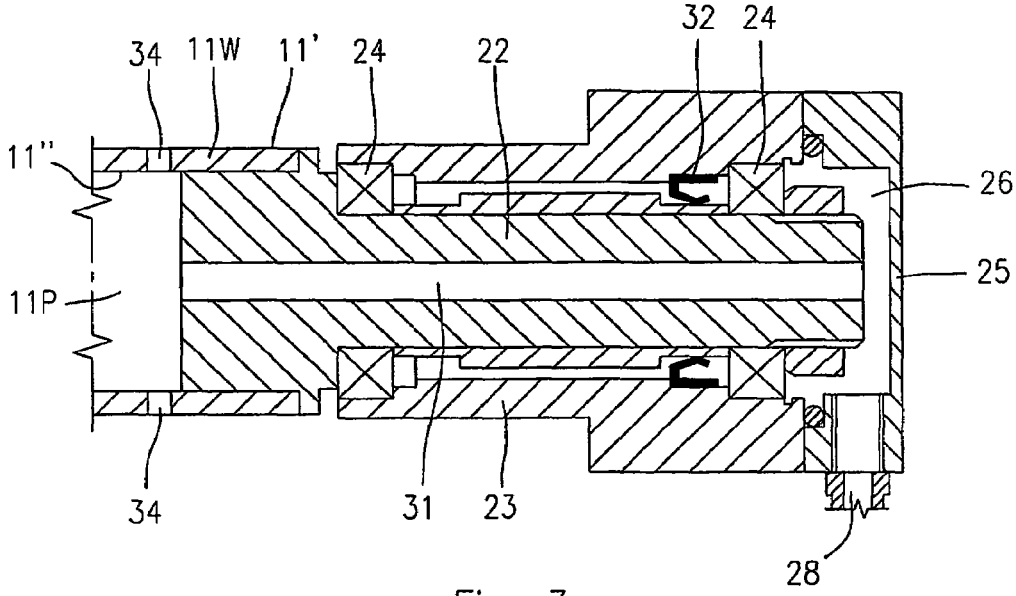
FIG. 3 shows an enlarged detail of the pneumatic joint of FIG. 2.
Figure 4:
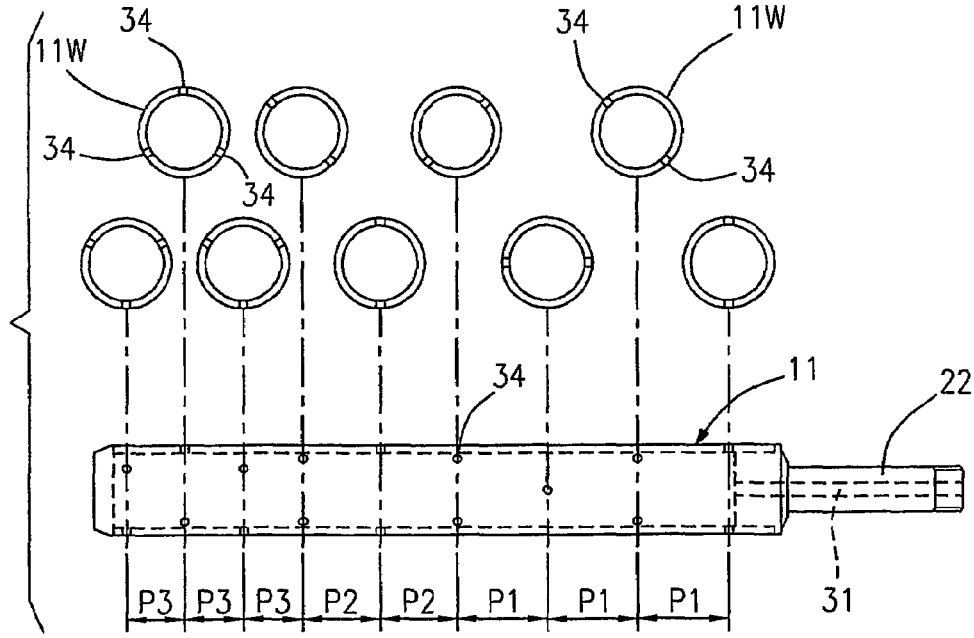
FIG. 4 shows a preferential disposition of the air-outlet holes for a spindle according to the invention.
Figure 5:
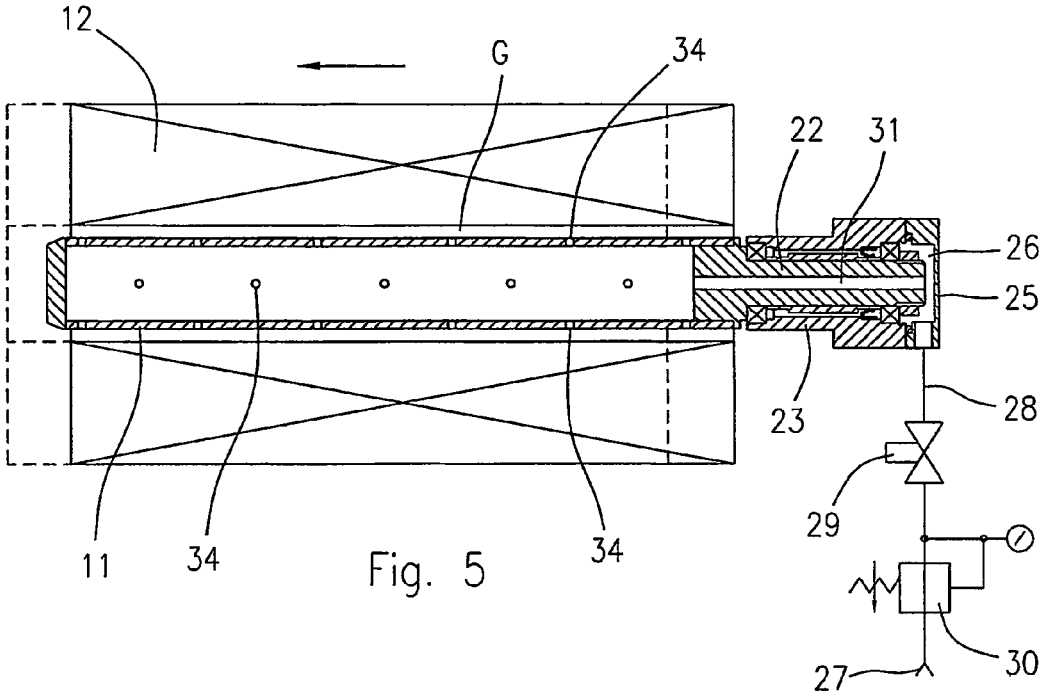
FIG. 5 shows a cross-sectional view similar to that of FIG. 2, during the removal of a roll.
Figure 7:
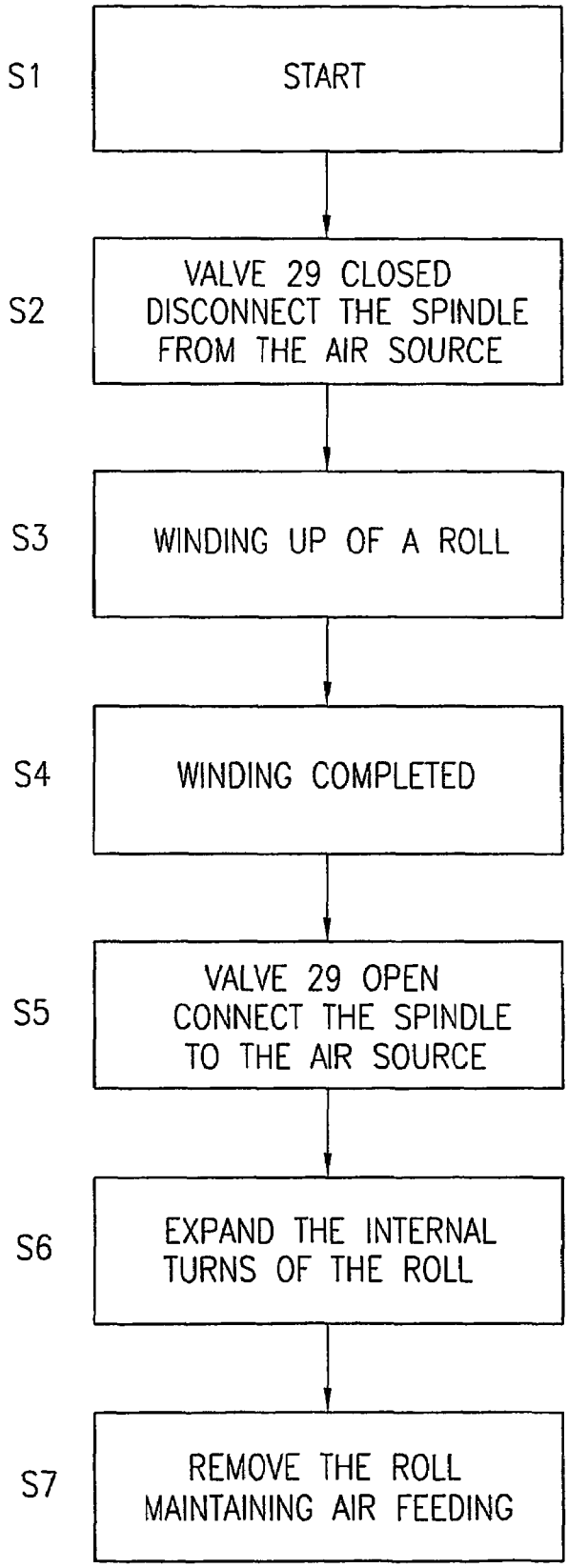
FIG. 7 is a flow chart describing the method according to the invention.

For such purpose, the spindle 11 is conformed as shown in FIG. 2, 3 or 4, while the roll 12 is removed by the method described further on, with reference to FIGS. 5 and 7 of the drawings.

In particular, as shown in the example of FIGS. 2 and 3, the spindle 11 comprises an elongated tubular body having a peripheral wall 11W provided with an outer cylindrical surface 11' and an inner cylindrical surface 11", defining a tubular chamber 11P, closed at both ends. The spindle 11 is rotatably supported at one end by a hollow shaft 22, forming part of a pneumatic joint for connection of the tubular chamber 11P of the spindle, to a pressurised air source 27.

More precisely, as shown in the detail of the enlarged view of FIG. 3, the shaft 22 of the spindle is supported to idle rotate by a sleeve 23 or other support element, by means of bearings 24. The support sleeve 23 for the spindle shaft 22 is closed at the rear end by a cover 25 defining an air chamber 26 which can be selectively connected to a pressurised air source 27, in FIG. 2, by means of a duct 28 comprising a solenoid valve 29 and a pressure regulator 30, to control the feeding of the pressurised air.

The air chamber 26 is also connected to the tubular chamber 11D of the spindle 11, by a flow passage consisting of a longitudinal hole 31 in the shaft 22; a lip seal 32 tightly closes the air chamber 26 from the outside, while allowing the spindle 11 to rotate.

The peripheral wall 11W of the spindle, is in turn provided with a plurality of air-outlet through holes or perforations 34, for discharging the air; the holes 34 extend between the inner and outer surface 11" and 11' of the body wall 11W to communicate the internal chamber 11P with the outer surface 11' of the spindle body, onto which the plastic film 10 is directly wound during the formation of a roll 12.

Preferably, the air-outlet holes 34 are directed radially and differently spaced apart and/or disposed along the wall 11W of the spindle, as explained further on; however, different orientations and/or different dispositions of the holes 34, compared to that shown, are not excluded.

The diameter and the number of the holes 34, and their disposition along the wall 11W of the spindle, should be calculated and chosen so as to ensure a sufficient delivery of air, and an appropriate pressure drop along the tubular chamber 11P for causing a sufficient radial expansion of the internal turns of the roll 12, capable of maintaining the roll floating on an air cushioning during the removal.

In the example of FIG. 2, the holes 34 have been shown in an aligned condition, in which rows of holes are parallely arranged to the longitudinal axis of the spindle 11; the rows of holes 34 can be angularly spaced apart from one another for example by 30°, 45° and/or by 90°, depending on the number of holes and rows contemplated for the spindle.

Moreover in FIG. 2 the holes 34 along each row are spaced apart from one another by a constant pitch, with the holes of each row axially staggered, for example by half a pitch, with respect to the holes of the adjacent rows.

Conversely, a different disposition of the holes 34 is shown in FIG. 4; in this case, the holes 34 are disposed along a helical line, with a variable pitch P. In particular, as shown in a position overlying the spindle 11, which refers to the disposition of the holes 34 in a certain number of cross sectional areas of the spindle, according to this example there are two diametrically opposed holes 34 in correspondence with a first set cross-sectional areas spaced apart by a first pitch P1, starting from the rear shaft 22. The first set of holes 34 is followed by an intermediate set of two diametrically opposed holes 34 in cross-sectional areas, spaced apart by a second pitch P2 smaller than the previous one P1, and then a third set of three holes at 120° in cross-sectional areas having a third pitch P3 smaller than the pitch P2.

This solution provide a holes disposition having variable pitches, decreasing from the rear end of the spindle in correspondence to the air inlet, to the opposite or fore end for the removal of roll 12; this disposition and spacing of the air-outlet holes 34, has been considered particularly advantageous in that the reduction in the pitch and the consequent shorter distance between holes 34 in the intermediate and fore position of spindle, makes it possible to achieve sufficient compensation for the pressure drops that occur inside the chamber 11P of the spindle, as the holes 34 are gradually uncovered by the progressive withdrawal of the roll 12.

The method for the winding and removal of coreless rolls, according to this invention, can be explained in greater detail with reference to the FIGS. 1, 2, 5 and 7 of the drawings.

As shown in FIGS. 1 and 2, the plastic film 10 is fed and made to advance towards the drum 20, and then wound up into a roll 12, directly onto the spindle 11, without any internal supporting core, in direct contact with outer surface 11' of the spindle, as clearly shown in FIG. 2.

At the start S1, the valve 23 is closed to disconnect the spindle 11 from the air source 27, step S2; during the winding of the roll 12, step S3, the solenoid valve 29 is maintained closed, thus preventing the feeding of the airflow.

After the winding of the roll 12 has been completed, step S4, having to move the roll 12 away from the drawing drum 20, the solenoid valve 29 is opened to connect the spindle to the air source 27, step S5, and to feed a flow of pressurised air into the tubular chamber 11P of the spindle 11.

The air under pressure, flowing out from the holes 34, causes the expansion of some internal turns of the roll, step S6, which become detached from the peripheral outer surface 11' of the spindle, as shown in FIG. 5, step S6, being sustained by the air cushioning, flowing along the annular gap G between the outer surface 11' of the spindle 11 and the inside turns of the roll 12.

At this point the roll 12 can be easily removed from the spindle 11, step S7, maintaining the feeding of the pressurised air for the time necessary to complete the withdrawal operation.

Since during the removal of the roll 12, all the holes 34 or perforated areas of the spindle are progressively uncovered, starting from the rear end, inside the spindle a variable pressure drop is generated which, if it were not controlled could cause the internal turns of the roll to collapse again against the spindle 11, thereby preventing or making the removal of the roll 12 more difficult.

In this case, it is possible prevent the collapsing of the internal turns of the roll by operating in different modes, while maintaining the airflow. For example it is possible to adopt a disposition of the perforations or holes having a variable pitch and/or variable cross dimensions of the holes or perforations, and/or more closely spaced apart, or a progressively larger number of holes or perforation at fore end of the spindle 11; it is also possible to operate on the flow regulator 30 to change or increase the flow-rate and/or the pressure of the aria fed to the spindle 11.

In all the cases, a controlled winding of coreless rolls and their easy removal is achieved by means of a method, which makes use of an extremely simplified spindle and means.

After having completed the removal of the roll 12, the flow of air to the spindle 11 is interrupted again to allow the winding of a new roll and its subsequent removal as explained previously.

Figure 6:
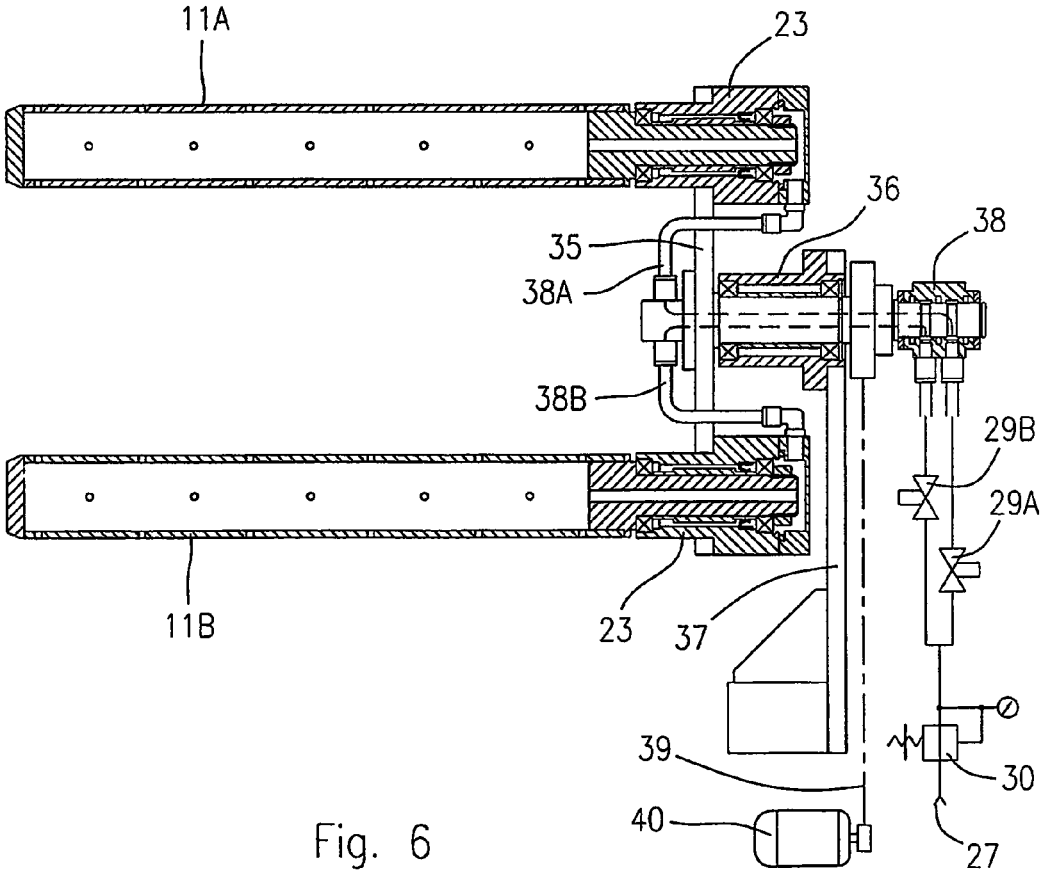
FIG. 6 shows an apparatus according to the invention provided with a double spindle.

FIG. 6 of the drawings shows, by way of example, an apparatus provided with two pneumatic spindles according to the invention, parallely arranged on a some support arm; therefore, in FIG. 6 the same reference numbers have been used to indicate parts similar or equivalent to those of the preceding figures.

The apparatus of FIG. 6 comprises a first spindle 11A and a second spindle 11B, wholly identical to each other and to the spindle 11 of FIG. 2.

The support sleeves 23 of the rotary air-feeding joints for the two spindles 11A, 11B are secured to a turntable arm 35, pivotally supported by an intermediate sleeve 36, secured to a bracket 37 or any other suitable supporting frame.

Each spindle 11A, 11B is pneumatically and selectively connectable to the air source 27, by means of respective ducts and solenoid valves 29A, 29B, through a rotary joint 38, having fluid connections 38A and 38B with the rotary air-feeding joints of the spindles 11A and 11B.

The intermediate rotary joint 38 is in turn connected, by means of a mechanical drive 39, to an electric motor 40 or control actuator capable of alternately causing a rotation of either one of the spindles 11A and 11B against a drawing drum 20 corresponding to the drum 20 of FIG. 1, to sequentially winding up separate rolls.

In this way, while the plastic film 10 for one roll 12 is being wound onto one of the two spindles, the roll 12 previously wound onto the other spindle can be removed according to the method previously described.

From what has been described and shown with reference to the accompanying drawings, it will be clear that a method, a pneumatic spindle, and respective apparatus for winding and removing coreless rolls of a plastic film, have been provided as previously described.

It is understood however that what has been described and shown in the accompanying drawings, has been given purely by way of example in order to illustrate the general features of the invention and several of its embodiments. Other modifications or variations both to the method, to the spindle, as well as to the entire apparatus can however be made, without thereby departing from the scope of the claims.

The invention claimed is:

1. A method for winding up and removing a careless roll (12) of an extensible or stretch plastic film (10) for packaging wound onto a spindle (11), comprising:

providing said spindle (11) with an air chamber (11P) having perforations (34) on a peripheral wall (11W);

winding up the plastic film (10) directly on the perforated wall (11W) of the spindle (11);

causing a radial expansion of internal turns of the roll (12);

supporting the expanded roll (12) by a cushioning of pressurised air, during withdrawal of the roll (12);

at a removal of a wound up roll (12), causing an expansion of some internal turns of the roll (12) by feeding a pressurised air flow through the air-chamber (11P) of the perforated wall (11W) of the spindle (12), into the internal turns of the roll (12), to disengage the internal turns from said perforated peripheral wall (11W) of the spindle (11); and during removal of the roll (12), controlling the air flow by changing an air-flow rate emerging from perforations (34), from a rear end to a fore end of the perforated wall (11W).

2. The method according to claim 1, further comprising maintaining the feeding of the pressurised air during at least part of the withdrawal step of the roll (12).

3. The method according to claim 2, further comprising maintaining the feeding of the pressurised air, throughout the entire withdrawal step of the roll (12).

4. The method according to claim 1, further comprising controlling the pressure of the air fed to the spindle (11), during the removal of the roll (12).

5. The method according to claim 1, further comprising increasing the air flow by increasing the number of perforations (34) from the rear end to the fore end of the peripheral wall (11W).

6. The method according to claim 1, further comprising increasing the flow of air by increasing the diameter of the perforations (34) from the rear end to the fore end of the peripheral wall (11W).

7. The method according to claim 1, further comprising reducing a space between the perforations (34), in a longitudinal direction of the spindle (11).

8. A spindle for winding and removal of coreless rolls (12) of an extensible or stretch plastic film (10) for packaging, comprising:

an elongated tubular body, provided with a tubular chamber (11P) longitudinally extending to a peripheral wall (11W), said wall (11W) having an outer winding surface;

a plurality of perforations opening out from the tubular (11P) chamber onto an outer surface (11') of the peripheral wall (11W); and a pneumatic joint (22, 23) conformed to rotatably support the spindle (11) and to connect the tubular chamber (11P) to a pressurised air source (27), wherein the spindle is configured such that during removal of the roll (12), the air flow is controllable by changing an airflow rate emerging from air-outlet holes (34), from a rear end to a fore end of the perforated wall (11W).

9. The spindle according to claim 8, wherein the peripheral wall (11W) of the spindle (11) comprises a number of parallely arranged rows of the air-outlet holes (34).

10. The spindle according to claim 9, wherein the holes (34) in each row are circumferentially aligned with the holes (34) of adjacent rows.

11. The spindle according to claim 9, wherein the holes (34) in each row are longitudinally staggered, with respect to the holes (34) of adjacent rows.

12. The spindle according to claim 8, wherein the holes (34) are spaced apart by a constant pitch (P).

13. The spindle according to claim 9, wherein the holes (34) are spaced apart by variable pitches (P1, P2, P3).

14. The spindle according to claim 13, wherein the pitches of the holes (34) are decreasing from the rear end to the fore end of the perforated wall (11W).

15. The spindle according to claim 8, wherein the holes (34) are arranged along at least one helicoidal path.

16. The spindle according to claim 8, wherein in correspondence of some cross sections, the perforated wall (11W) comprises a same number of holes (34).

17. The spindle according to claim 8, wherein in each cross section of the spindle (11), the perforated wall (11W) comprises an increasing number of the air-outlet holes (34).

18. The spindle according to claim 8, wherein the holes (34) have a same diameter.

19. The spindle according to claim 8, wherein the holes (34) are of different diameters.

20. The spindle according to claim 8, wherein the perforated wall (11W) of the spindle (11) comprises a body of porous material.

21. The spindle according to claim 8, wherein the perforated wall (11W) of the spindle (11) comprises a microperforated plate.

22. The spindle according to claim 8, wherein the perforated wall (11W) of the spindle (11) comprises a fine meshed net.

23. An apparatus for winding and removal of coreless rolls (12) of an extensible or stretch plastic film (10) for packaging, comprising:

at least one winding spindle (11), rotatably supported by a movable arm;

one film feeding unit (13, 15), and one film drawing unit (20) for winding up the extensible or stretch plastic film (10) for packaging onto the spindle (11), said spindle (11) being disengageably to the coreless roll (12) for the removal;

wherein the spindle (11) comprises:

an elongated body defining an air chamber (11P) having a perforated peripheral wall (11W), the perforated peripheral wall (11W) having perforations (34) configured such that during removal of the roll (12), an air flow is controllable by changing an airflow rate emerging from the perforations (34); and means for selectively connecting said air chamber (11P) of the spindle (11) to a pressurised air source (27).

24. The apparatus according to claim 23, wherein said means for the selective connection of the air chamber (11P) to the air source (27), comprises an hollow rotary joint (22, 23) for rotatably supporting the spindle (11), and valve means (29) for selective connection of the rotary joint (22, 23) to the air source (27).

25. The apparatus according to claim 23, further comprising:

first and second film winding spindles (11A, 11B) rotatably supported by a turntable arm (37);

control means (39, 40) to rotate said arm (37); and conduit and valve means (38A, 38B; 29A, 29B) for selective connection of the air chamber (11P) of each spindle (11A, 11B), to the air source (27).

26. The apparatus as claimed in claim 25, wherein said valve means (29A, 29B) comprises a pressure adjusting valve device.

27. The apparatus as claimed in claim 25, wherein said valve means (29A, 29B), comprises a flow-rate adjusting valve device.

28. An apparatus for winding and removal of coreless rolls (12) of an extensible or stretch plastic film (10) for packaging, comprising:

at least one mandrel, the mandrel having perforations configures such that during removal of the roll (12), an air flow is controllable by changing an air-flow rate emerging from perforations), from a rear end to a fore end of the mandrel;

a rotary joint (23) on the mandrel;

a valve (29) connected to the mandrel; and a pressure regulator (30) connected to the valve (29), the pressure regulator being configured to change at least one of a flow rate or pressure of pressurized air to cause radial expansion and compaction of internal turns of the rolls.

* * * * *